US006848195B2

(12) United States Patent
Leimu

(10) Patent No.: US 6,848,195 B2
(45) Date of Patent: Feb. 1, 2005

(54) BLOW BOX FOR CONTROLLING THE WEB RUN

(75) Inventor: Juha Leimu, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/494,890

(22) PCT Filed: Nov. 7, 2002

(86) PCT No.: PCT/FI02/00866

§ 371 (c)(1),
(2), (4) Date: May 7, 2004

(87) PCT Pub. No.: WO03/040468

PCT Pub. Date: May 15, 2003

(65) Prior Publication Data

US 2004/0244218 A1 Dec. 9, 2004

(30) Foreign Application Priority Data

Nov. 8, 2001 (FI) ..... 20012160

(51) Int. Cl.[7] ..... F26B 7/00
(52) U.S. Cl. ..... 34/115; 34/119; 34/125
(58) Field of Search ..... 34/114, 115, 116, 34/117, 119, 125; 162/358.1, 359.1

(56) References Cited

U.S. PATENT DOCUMENTS 4,669,198 A 6/1987 Wedel
4,905,380 A * 3/1990 Eskelinen et al. ..... 34/457
5,037,509 A * 8/1991 Wedel ..... 162/286
5,341,579 A 8/1994 Schiel et al.
5,792,318 A * 8/1998 Mancini ..... 162/193
6,032,385 A * 3/2000 Bischel et al. ..... 34/456
6,247,247 B1 * 6/2001 Yomaa et al. ..... 34/425
6,317,999 B1 11/2001 Virta et al.

FOREIGN PATENT DOCUMENTS

FI 110624 2/2003
WO WO 00/50692 8/2000

* cited by examiner

*Primary Examiner*—Stephen Gravini
(74) *Attorney, Agent, or Firm*—Cohen, Pontani, Lieberman & Pavane

(57) ABSTRACT

A blow box (18) for supporting the web run in a paper machine or the like, which blow box comprises members for maintaining a negative pressure at least in one negative pressure region (24) between the wire (20) and the blow box. The members comprise a blocking member (30, 32), which is arranged, regarding the wire's running direction, at the beginning and/or at the end of said negative pressure region, which extends across the wire and projects towards the wire, and which is movable in relation to the blow box, and blowing members (34, 36), with which air is ejected with blows between said blocking member and the wire from said negative pressure region and/or with which air is prevented from entering this negative pressure region. The blocking member is connected to the blow box by a hinge member (40, 42), which allows the blocking member to rotate around the articulation point of the hinge member due to the pressure difference between the pressure acting on the blocking member's blocking surface (30', 32') directed towards the wire and the pressure acting on the blocking member's back surface (50, 50') directed away from the wire.

12 Claims, 5 Drawing Sheets

BLOW BOX FOR CONTROLLING THE WEB RUN

PRIORITY CLAIM

This is a U.S. national stage of application No. PCT/FI02/00866, filed on 07 Nov. 2002. Priority is claimed on that application and on the following application(s): Country: Finland, Application No.: 20012160, Filed: 08 Nov. 2001.

BACKGROUND OF THE INVENTION

The present invention relates to a blow box for controlling or supporting the web run in a paper machine, particularly in the drying section of a paper machine, or in other corresponding devices, such as in a board machine, in a finishing machine and in coating machines.

The web run needs control or support, for instance during running in the area of the pockets formed between the drying cylinders in the drying section of a paper machine, particularly in such locations where the web needs to be released in a controlled manner from a drying cylinder and to run freely together with the wire to a turning roll, suction roll or the like.

In order to support the web at the pockets of the drying section it is known to use blow boxes, which eject air away from desired regions in order to create a negative pressure in these regions. Thus the negative pressure created by the blow boxes can be used to support the release of the web from a drying cylinder and to support the web run to a turning roll or the like.

It is known to arrange in a blow box, at the beginning and/or at the end of the negative pressure region created by the box, a blocking plate or the like, which projects towards the web and which is flexibly fastened to the blow box. The object of the blocking plate is to seal the negative pressure region from the surrounding space in order to maintain an as effective negative pressure as possible in the negative pressure region. The surface of the blocking plate, which is directed towards the web, can be protrudingly arched towards the web, with respect of the running direction of the web. The arched surface forms a so called Coanda surface, which facilitates the ejection of air away from the negative pressure region and prevents leaking air from entering the negative pressure region.

In this way, with the blow boxes in use, it can be created, with reasonable blow effects, intensified negative pressure regions having negative pressures of e.g. 0.1 to 0.4 kPa. However, as the paper machine speeds still rise and as the paper quality requirements increase, the order of the negative pressure level at particularly critical points should be even higher than 5 kPa.

However, the intensifying of the negative pressure level from the present, i.e. the maintaining of an even higher negative pressure with the aid of blowers, substantially increases the required blowing effect, in other words the energy costs. The higher the aimed negative pressure level, the larger are also the air leaks and their impacts on the energy costs. It is not possible to completely seal the negative pressure region from the surrounding space in order to reduce the leaks. Blocking members, blow nozzles or other structures of a blow box arranged too close to the wire can easily damage the wire, and they can themselves be easily damaged when the wire touches them. Thus, with the present devices there must be left a certain minimum gap between the blow boxes and the web's supporting wire in order to avoid damage to these members, to the web and/or to the wire in different running situations.

For instance a "paper lump" can push the wire to touch parts of the blow box, particularly the blow nozzles or blocking members, despite the minimum gap. In known blow boxes, a spring or some other mechanical member is used to keep nozzles projected towards the wire. The object is that the spring enables the nozzle to be pushed away from the wire, when required. However, springs are generally relatively stiff, and they are not sufficiently resilient in order to be able to adapt to all situations sufficiently rapidly. In addition, the spring force cannot be adjusted to different requirements. The spring must be subjected to a relatively high minimum pressure before it allows the nozzle to be pushed away from the wire.

SUMMARY OF THE INVENTION

The object of the present invention is to provide a blow box where the above described problems are minimized.

The object is to provide a blow box which can create a high negative pressure level in a desired region, without too high energy costs.

An object is also to provide a blow box which can create a high negative pressure level in a desired region, with as small air leaks as possible.

A further object is to provide a blow box, which enables the high negative pressure level created by the box to be maintained at a suitable level in different running situations, without danger to the wire or to the web.

A blow box according to the invention is typically used to create a negative pressure region in the pocket between two drying cylinders in the drying section of a paper machine, at the opening nip between a drying cylinder and the wire, in order to support the web run and to improve the machine's runnability. On the other hand, a blow box according to the invention can be used also in other places of a paper machine or corresponding machines as a component, which supports the web run and improves the runnability.

A typical blow box according to the invention, which is arranged for instance in the pocket between two drying cylinders in the drying section of a paper machine, comprises members to maintain the negative pressure in at least one negative pressure region between the wire and the blow box.

These members comprise a blocking member, which is arranged, regarding the wire's running direction, at the beginning and/or at the end of said negative pressure region, which blocking member extends across the wire and projects towards the wire, and which is movable in relation to the blow box, in order to make it possible to maintain a pressure difference between said negative pressure region and the region outside this region, and blowing members, with which air is ejected with blows between said blocking member and the wire from said negative pressure region and/or with which air is prevented from entering this negative pressure region.

Said blocking member is connected to the blow box with a hinge member, such as a swing joint. The hinge member allows the blocking member to rotate around the articulation point of the hinge member due to the pressure difference between the pressure acting on the blocking member's blocking surface directed towards the wire and the pressure acting on the blocking member's back surface directed away from the wire.

Advantageously the blocking member's blocking surface projecting towards the wire is shaped so that the surface's distance from the wire supporting the web changes as the blocking member rotates about the articulation point of the hinge. Thus the blocking member is arranged to rotate around the articulation point, due to the pressure acting on its back surface directed away from the wire, so that the blocking member projects towards the wire. Correspondingly, the blocking member is arranged to rotate around the articulation point due to the pressure acting on its blocking surface directed towards the wire, so that the blocking member projects away from the wire.

The blocking member used in the solution according to the invention moves substantially more delicately than a blocking member projected by a spring towards the wire. By controlling the pressure acting on the blocking member's back surface directed away from the wire or on the blocking member's blocking surface it is easy to adjust the blocking member's distance from the wire, i.e. the gap between the blow box and the wire. The blocking member's back surface directed away from the wire can be arranged to border to a separate pressurised space, or to a pressurised space which can be controlled in part independently. By controlling the pressure of this space it is possible to push the blocking member towards the wire with a desired pressure. Already a very small change in the pressure makes the blocking member to move in the desired direction. Thus a blocking member, which can be freely rotated around the hinge's articulation point, can be easily pushed towards the blow box due to a very small "paper lump" or some other approach of the wire, without damage to the wire or to the actual blocking member.

Even a small pressure change on either side of the blocking member causes the blocking member to move towards the wire or away from the wire. The air jets, which are blown along the blocking member's surface and which eject air from die negative pressure region, will cause a negative pressure between the blocking member and the wire, whereby this negative pressure pushes the blocking member towards the wire and prevents air leaks from entering the negative pressure region. The blocking member can be prevented from extending too close to the wire with the aid of a mechanical limiter, against which the blocking member hits when it rotates to the allowed extreme position, and which thus prevents the blocking member from rotating past this extreme position. Thus a blow box according to the invention can be arranged very close to the web.

When using a blow box according to the invention it is possible to advantageously arrange both blocking members and blow nozzles both at the beginning and at the end of the negative pressure region, whereby the nozzles blow/eject air out from the negative pressure region along the blocking member's surface. Together the ejecting blows and the blocking members prevent effectively air from escaping from the outside of the negative pressure region into the negative pressure region. The nozzles, which can be fixedly joined to the blow box can be arranged at a safe distance from the web.

In addition the blocking member and the blow nozzle at the corresponding point are advantageously shaped congruently, so that the blocking member's blocking surface passes along the outer surface of the nozzle when the blocking member is rotating and leaves a gap of a desired size between the nozzle and the blocking surface. The blocking surface and the nozzle are advantageously shaped so that the gap between them grows as the blocking member is pushed away from the wire, whereby more air than in the normal state is allowed to flow out from behind the blocking member, in other words from the space between the blocking member's back surface and the blow box. Then the pressure in the space behind the blocking member will decrease, and the blocking member can be pushed more easily than before away from the wire. In this manner the blocking member can be rapidly pushed away from the wire, for instance when a "paper lump" pushes the wire towards the blow box.

When desired, it is also possible to arrange members in the blow box in order to suck air away from the negative pressure region. In this way the negative pressure can be intensified, even to a level above 5 kpa. In addition, when required it is possible to maintain a lower negative pressure than this intensified negative pressure, such as a negative pressure of 0.1 to 0.4 kPa, in the other parts of the pocket, in other words outside the intensified negative pressure region.

In a blow box according to the invention a blocking member arranged at the beginning of the negative pressure region can at its first end, as seen in the running direction of the web, be connected to the blow box e.g. with a swing joint, which allows a frictionless or almost frictionless movement of the blocking member around the articulation point of the swing joint. A counter weight can be connected to the first end of the blocking member in order to keep the blocking member in balance at the desired distance from the web during a normal run. This facilitates keeping the gap between the web and the blocking member at a desired size. Thanks to the counter weight the blocking member is at a particularly mobile state, in other words it can be turned away from the wire or towards the wire in a sensitive manner.

A blow nozzle is arranged, as seen in the wire's running direction, advantageously at the second end of the blocking member (i.e. at the output end of the wire), which blocking member is arranged at the beginning of the negative pressure region in the blow box, and which, as seen in the wire's running direction, at its first end (i.e. at the input end of the wire) is connected through a swing joint to the blow box.

A blocking member, which is arranged in the blow box at the end of the negative pressure region, can be connected at its first or second end, as seen in the wire's running direction, to the blow box via a swing joint. Advantageously a blow nozzle is arranged in connection with the first end of the blocking member, as seen in the wire's running direction.

A limiter can be arranged in the blow box, typically in the blow nozzle structure, so that the limiter prevents the blocking member from turning closer to the wire than a predetermined minimum distance from the wire.

The blocking member can be made as a uniform structure with a width substantially equal to the width of the web. When desired the blocking member can be made of two, three or more parts, for instance of pieces having a length of 0.5 to 1.5 m, typically about 0.8 m, and which are arranged one after the other in the web's cross direction, so that they form a blocking member with the width of the web. In the latter case the distance of the different blocking member parts from the wire can be controlled separately. In this manner it is for instance possible to separately allow for the movements of the edge portions of the wire and ensure that the negative pressure is kept at the desired level also in these regions.

BRIEF DESCRIPTION OF THE DRAWINGS

The invention is described below in more detail with reference to the enclosed drawings, in which.

DETAILED DESCRIPTION OF THE PREFERRED EMBODIMENTS

Figure 1:
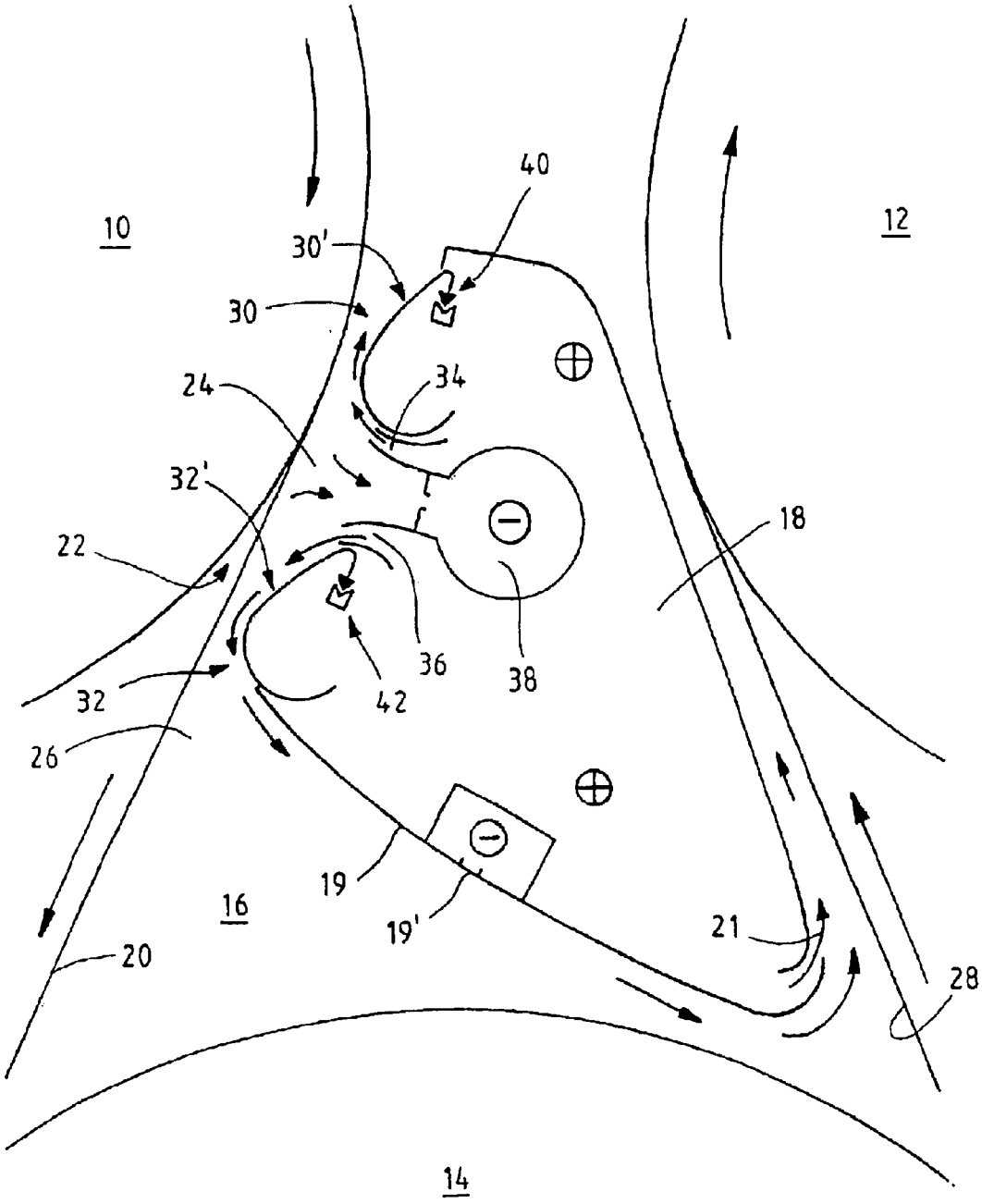
FIG. 1 shows schematically a blow box according to the invention arranged in the pocket formed between two drying cylinders in the drying section of a paper machine provided with a single wire run.

FIG. 1 shows a cross section of the drying section of a paper machine provided with a single wire run, a pocket 16 formed between its two drying cylinders 10, 12 and a suction roll 14, where a blow box 18 according to the invention is arranged. The blow box 18 is arranged between the first drying cylinder 10 and the second drying cylinder 12 in the running direction of the wire 20, which supports the web.

The blow box 18 is arranged to cover the wire run 20 at a point where the wire is released from the first drying cylinder 10, in other words at the opening nip 22 between the wire and the drying cylinder. The blow box creates in this point a intensified negative pressure region, in the space 24 between the wire 20 and the blow box 18, whereby this space is sealed from the rest of the space of the pocket 16.

In the solution presented in FIG. 1 the blow box does not cover the wire run 20 on the later part 26 after the opening nip between the first drying cylinder 10 and the suction roll 14, and no separate negative pressure is directed at this later part 26 from the side of the pocket, in the case shown in FIG. 1. In this way a bending of the central part of the wire run is avoided, which in some cases could be the result of using a too high negative pressure. Advantageously the blow box covers less than half, typically about a fifth of the wire run 20 between the drying cylinder 10 and the suction roll 14. Of course it is also possible to apply the invention in such blow box solutions, in which the blow box covers a larger part of the wire run than that mentioned above.

When desired, it is also possible to direct against this later wire run 26 or a portion of it, a negative pressure which is weaker than that described above. It is for instance possible to arrange one or more suction openings 19', which are connected to a suction pipe or the like on the side 19 of the blow box directed towards the suction roll. On the other hand the negative pressure can be created also by ejecting air away from the space between the blow box 18 and the suction roll 14 with the aid of blows 21.

In the case of FIG. 1 the blow box 18 covers the main part of the wire run 28 between the second drying cylinder 12 and the suction roll 14.

In order to seal the space 24 from the rest of the pocket space the blow box 19 is provided with two blocking members 30, 32. Thus the blow box has a first blocking member 30 at the input side of the negative pressure region 24, as seen in the wire's 20 running direction, and a blocking member 32 at the output side of the negative pressure region 24, as seen in the wire's 20 running direction. In the case of FIG. 1 both blocking members are provided with Coanda surfaces 30' and 32', which extend from the blow box towards the wire 20.

Blow nozzles are arranged in connection with the Coanda surfaces 30', 32', so that the first nozzle 34 blows air over the first Coanda surface 30' against the running direction of the wire 20 and ejects air out from the negative pressure region 24 defined by the blow box 18, the wire 20 and the blocking members 30, 32.

The second blow nozzle 36 blows air over the second Coanda surface 32' downstream with respect of the running direction of the wire 26, and thereby it intensifies the negative pressure in the space 24.

In addition, in the case shown in FIG. 1, members 38 are arranged in the blow box between the blocking members 30 and 32 in order to remove air from the negative pressure region 24 with the aid of suction. When desired the negative pressure can be created only by blows.

The blocking members 30 and 32 are connected with swing joints 40, 42 to the other structures of the blow box, so that each blockng member freely can be turned around the articulation point of the swing joint. Thus the blocking members 30, 32 can rotate around the articulation points of the hinges, so that the Coanda surfaces 30', 32 of the blocking members move closer to the wire 20 or away from the wire.

In the case of FIG. 1 both blocking members 30 and 32 are basically identical. However, the solution according to the invention can be also applied so that the blow box has only one blocking member provided with a swing joint or the like. The second blocking member can be some other solution, which has been found adequate. The surface of the blocking members directed towards the wire may also have a form, which is different from the smoothly arched Coanda surfaces shown in FIG. 1. The blocking surfaces of the blocking member can for instance be formed by a plate, which is bent 2, 3 or more times into a partly arched form. Thus the blocking surfaces can be formed by linear plate sections.

Figure 2:
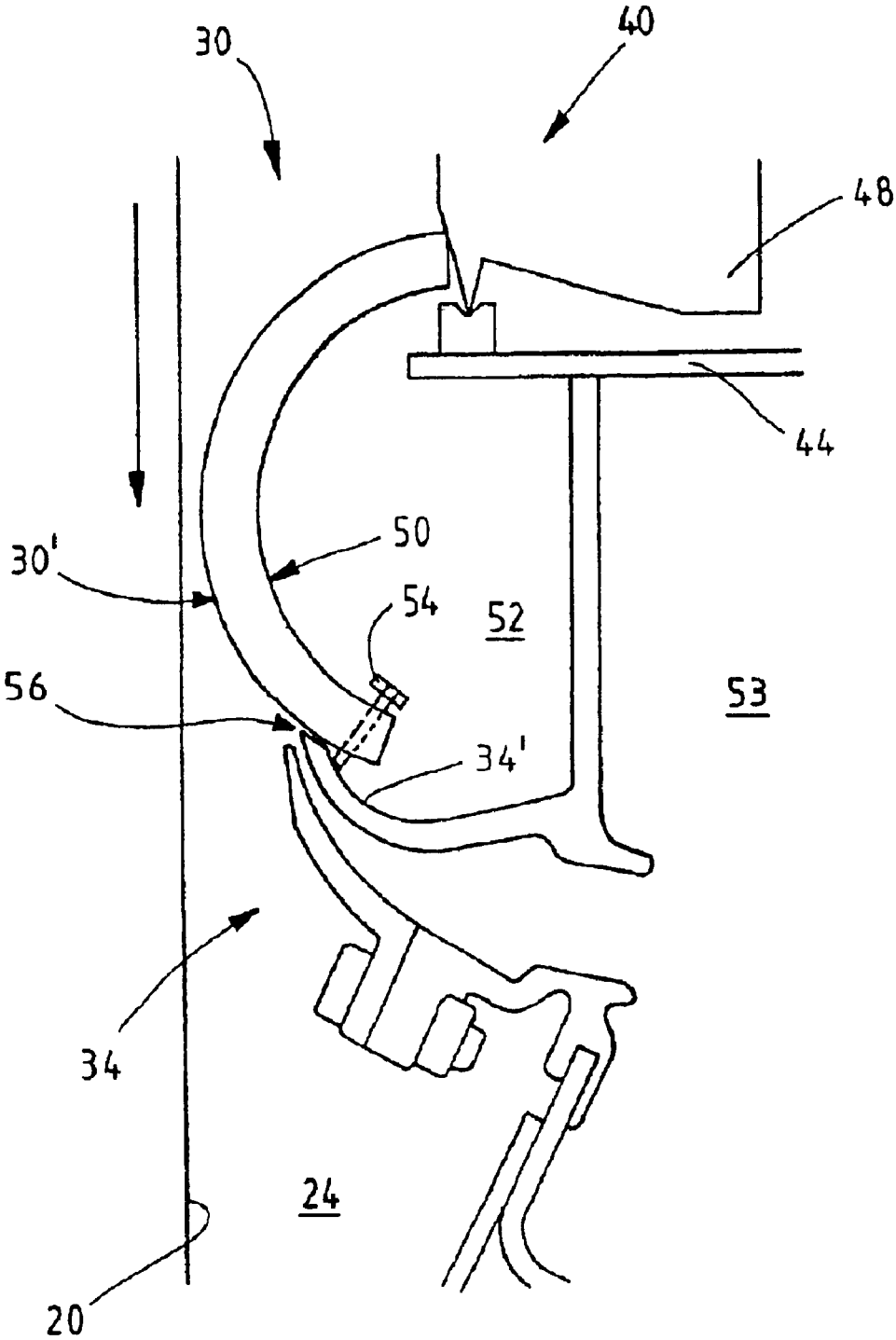
FIG. 2 shows schematically the cross-section of a blocking member and blow nozzle construction, which is suitable for application in a blow box according to the invention.

FIG. 2 shows in an enlarged view a blocking member, which is of the same type as the blocking member 30 shown in FIG. 1, whereby a blow nozzle 34 is connected to the blocking member. The blocking member 30 is connected via a swing joint 40 to the structures 44 of the blow box 18. In addition a counter weight 48 is arranged in the blocking member 30, so that this counter weight keeps the blocking member in a suitable position regarding the wire run 20, in other words at a suitable distance from the wire during a normal run and/or during shutdown. The counter weight keeps the blocking surface 30' of the blocking member at the desired distance from the wire run. An adjustable limiter 54 is arranged at that end of the blocking member which is away from the hinge, which limiter hits the limiting wall 34' when the blocking member rotates towards the wire, and prevents the blocking member from turning closer to the wire than a predetermined distance. When desired the limiter can be arranged at other parts of the blocking member. The back surface 50 of the blocking member 30, which is directed away from the wire, borders to the partial space 52 of the blow box 53.

The blow nozzle 34, which ejects air out from the negative pressure region 24 between the wire and the blow box, is arranged in the blow box structures so that only a very small gap 56 is left between the blocking surface 30' of the blocking member 30 and the outer surface 34' of the blow nozzle 34. The blow nozzle 34, particularly its outer surface, and the blocking member 30, particularly its blocking surface, can be shaped so that the gap 56 is very small, at least in the so called rest position of the blocking member, whereby the amount of air escaping from the air space 52 through this gap 56 into the negative pressure region 24 is minimised However, according to a preferred embodiment of the invention the outer surface 34' of the blow nozzle and the blocking surface 30' of the blocking member are shaped so that the size of the gap 56 depends on the position of the blocking member. The gap 56 is increased or reduced when the blocking member is rotated, as shown in the following FIGS. 3 and 4.

Figure 3:
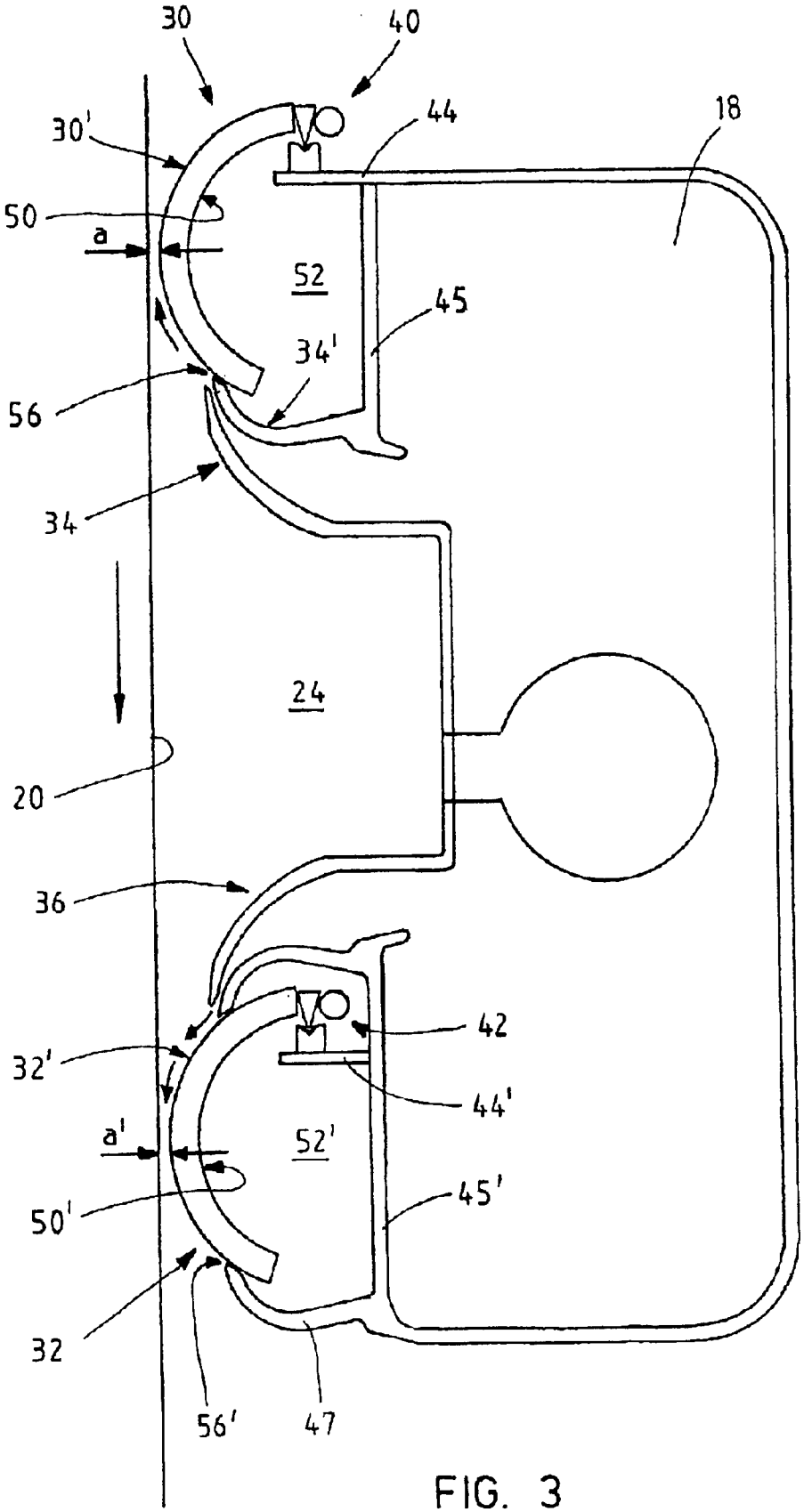
FIG. 3 shows schematically the cross-section of the negative pressure region defined by a blow box according to the invention, its blocking members and the wire.
Figure 4:
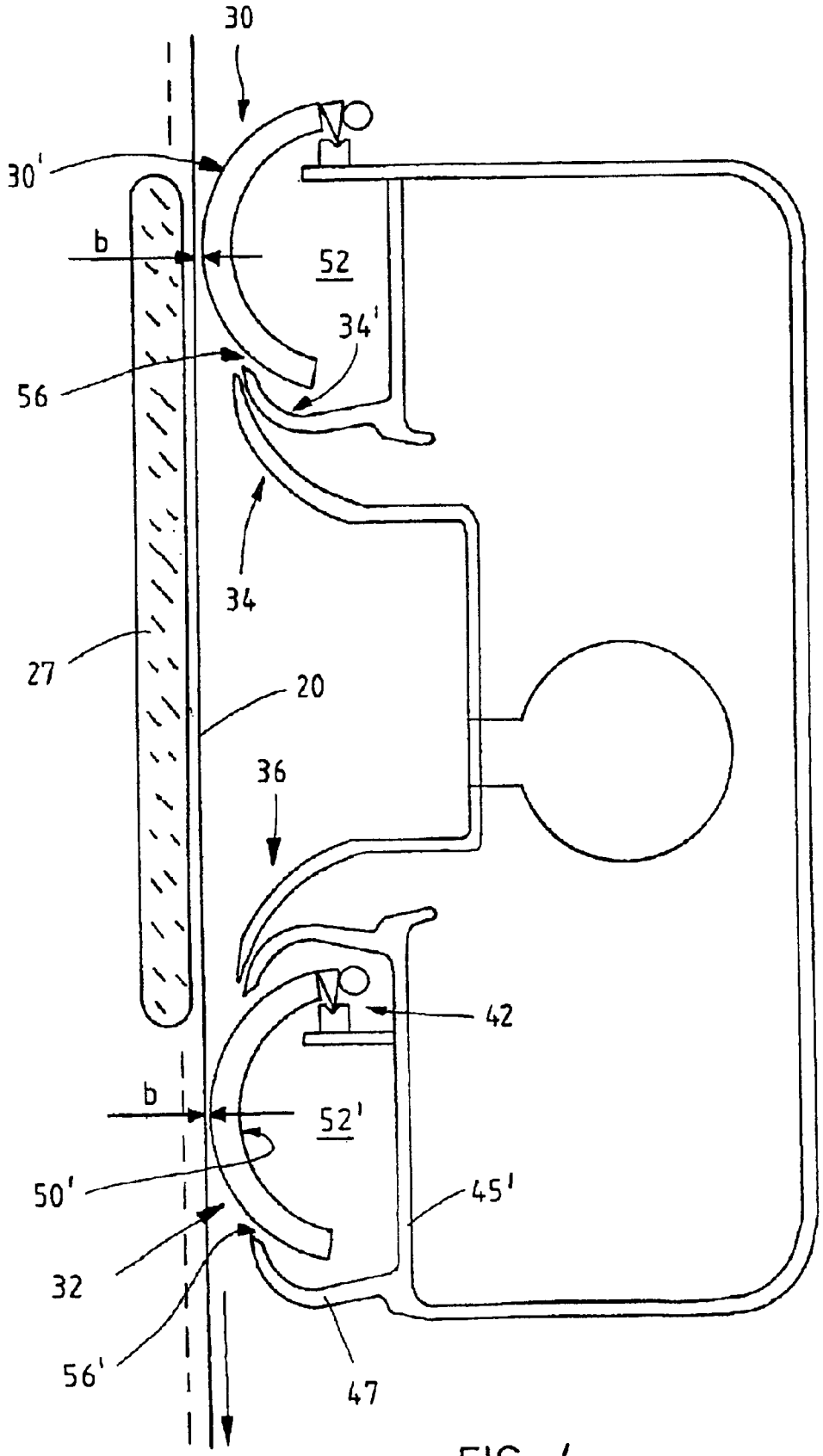
FIG. 4 shows the solution according to FIG. 3 when a "paper lump" presses the wire against the blow box.
Figure 5:
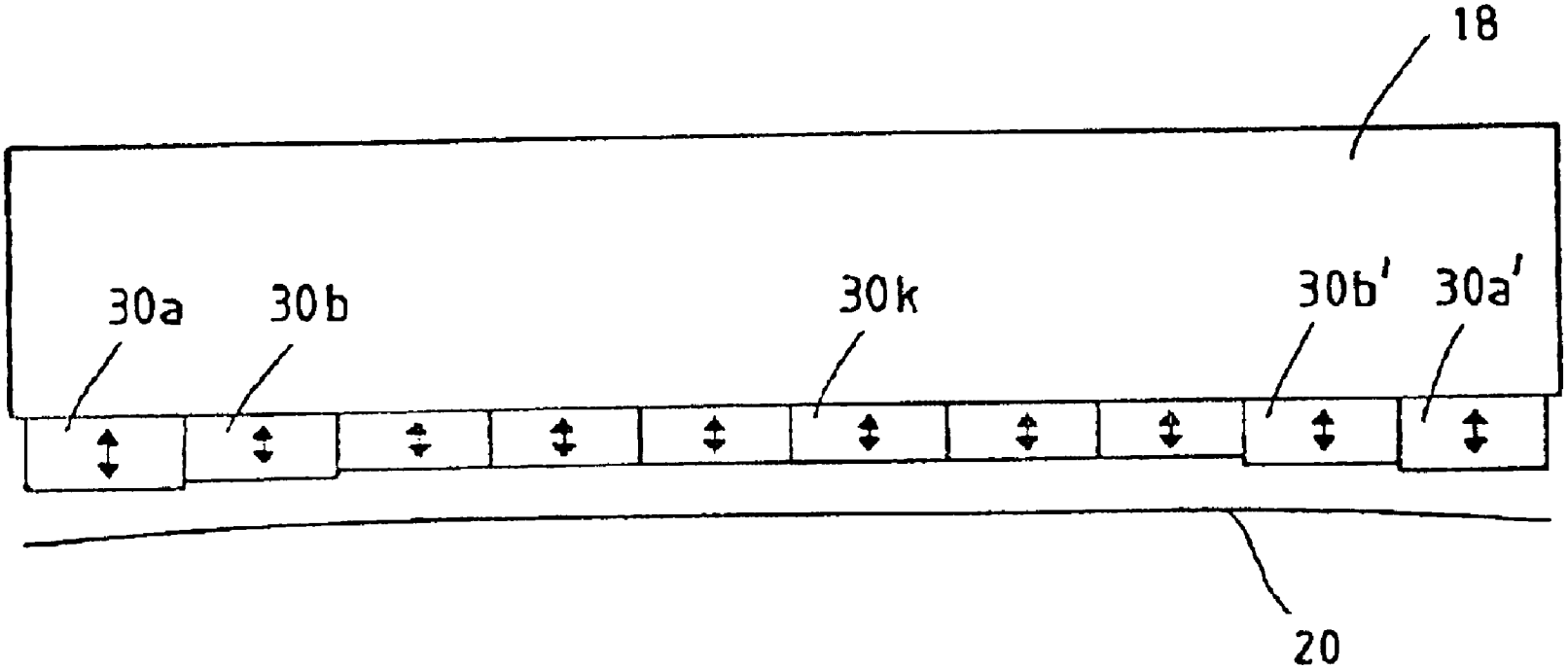
FIG. 5 shows schematically in a top view the blow box according to FIG. 1 and the wire.

The FIGS. 3 to 5 show the function of the blocking members in a blow box according to the invention in different running situations. The reference numerals used in FIGS. 1 and 2 are also used in the description of FIGS. 3 to 5.

FIG. 3 shows the negative pressure region 24 created by the blow box 18, whereby the negative pressure region is formed in the space defined by the wire 20, the blow box 18 and the first blocking member 30 and the second blocking member 32 according to FIG. 2. Both blocking members are connected at their first ends, as seen in the running direction of the wire run 20, through swing joints 40, 42 to the structures 44, 44' of the blow box. A first blow nozzle 34 and a second blow nozzle 36 are arranged between the negative pressure region and the blocking members 30 and 32.

The first blow nozzle 34 is arranged to eject air from the negative pressure region 24 over the Coanda surface 30' of the blocking member 30, upstream with respect of the running direction of the wire run. The second blow nozzle 36 is arranged to eject air from the space 24 over the Coanda surface 32' of the blocking member 32, downstream with respect of the running direction of the wire run. Both blocking members 30, 32 are kept at a suitable distance a, a' from the wire 20 with the aid of a low positive pressure acting in the spaces 52, 52' on the back surfaces 50, 50' of the blocking members.

The first space 52 is defined by the back surface 50 of the first blocking member 30, the structures 45 of the blow box, and the outer surface 34' of the first blow nozzle 34. A small gap 56 is left between the blocking member 30 and the outer surface 34' of the nozzle, and this gap allows the blocking surface to rotate around the articulation point of the hinge 40. This gap 56 is very small during normal run, whereby it minimises the amount of air escaping from the space 52 to the space 24.

In a corresponding way the second space 52' is defined by the back surface 50' of the second blocking member 32 and the structures 45' of the blow box. The structures 45' bordering to the space 52' comprise a partition 47, which projects towards the wire. The partition 47 is shaped to form a relatively tight seam together with the blocking member 32, mainly with that end of the blocking member, which points away from the negative pressure region 24. The blocking member 32 and the partition 47 are shaped so that the very small gap 56' left between them still allows the blocking member 32 to rotate around the articulation point of the swing joint 42. During a normal run the gap 56' is so small that it minimises the amount of air flowing out from the space 52'.

The gap between the second blocking member 32 and the second blow nozzle 36 does not border directly to the space 52', and thus this gap does not have any direct effect on the pressure in the space 52'.

FIG. 4 shows a blow box according to FIG. 3 in a situation where a "paper lump" 27 or the like presses the wire 20 towards the blocking members 30 and 32, however without the wire touching these members. The distances b, b' between the wire 20 and the blocking surfaces 30', 32' of the blocking members 30, 32 are shorter than the distances a, a' in the case shown in FIG. 3. The broken lines in FIG. 4 show the wire run in the situation shown in FIG. 3. The ejection blows of the nozzles 34, 36 prevent the wire from touching the blocking surface. In a solution according to the invention, which utilises very mobile blocking members 30, 32, a rising pressure on the blocking surface side of the blocking members will cause the blocking members to project inward into the blow box, in other words towards the spaces 52, 52'.

The first blocking member 30 and the blow nozzle 34 are shaped so that the gap 56 between the blocking surface 30' and the nozzle's outer surface 34' increases and air can leak out from the space 52 as the blocking member is pushed towards the blow box. As air is leaking out from the space 52, the pressure or force contained in it, which normally pushes the blocking member towards the wire, will be reduced, and the blocking member allows the "paper lump" to be pushed towards the blow box, in other words, the blocking member is withdrawn from the path of the "paper lump" and the wire. In this way unnecessary damages to the wire or blow box components are avoided.

The pressurised space 52' on the backside of the second blocking member 32 is defined by the backside 50' of the blocking member and also by the blow box structures 45', from which a partition 47 projects towards the second blocking member 32. When a "paper lump" 27 presses the wire 20 and thus indirectly also the blocking member 32, the very mobile blocking member rotates around the articulation point of the hinge 42 and is pushed towards the blow box. The motion of the blocking member results in that the gap 56' between the blocking member and the partition 47 increases, whereby air can leak out from the space 52'. Therefore the pressure in the space 52' is reduced, and the blocking member can be pushed away from the path of the "paper lump" and the wire more easily than previously, and without any damages.

The blocking member 30 shown in the FIGS. 1 to 4 can be formed of, in the cross direction of the wire, two or more separately rotating blocking member components 30*a*, 30*b*, . . . 30*k*, which components are connected one after the other so that they form an entity extending across the web. FIG. 5 shows in a top view a blow box 18, which is arranged in front of the wire 20 and which contains a blocking member formed by several separate blocking member components 30*a*, 30*b*, 30*c*, 30*d*, . . . 30*k*. Each blocking member component takes its place according to the invention at a suitable distance from the wire. In the case shown in FIG. 5 the wire's edges bent away from the blow box, and therefore the blocking member components 30*a* and 30*a'* at the edge regions project farther out from the blow box than the other blocking member components. The next blocking member components 30*b*, 30*b'* project also slightly more outwards than the blocking member components 30*k* in the central part of the blow box.

A fault in the shape of the wire and/or the blow box can be compensated for by dividing the blocking member into components, by imitating the arched form with a broken line. The distance of the blocking member to the wire can be controlled individually for each blocking member component, when required.

Now it has been realised that the blocking surface of a "floating" blocking member arranged in the blow box, similar to the blocking surface shown in the FIGS. 1 to 4, will automatically find the correct distance to the adjacent wire. Now it is possible to eliminate springs and other mechanical obstacles, which previously were used to restrict the movements of the blocking member, and the blocking member is allowed to move freely or almost freely as close to the wire as it wants to go.

The blocking member supported to be mobile according to the invention finds the correct distance to the wire, also as the wire bends. With the aid of the blocking member it is thus possible to maintain with the blow box a negative pressure level, which is as effective as possible with as small air leaks as possible, in other words, without too high energy costs. This will also at least partly compensate for a bending wire at high negative pressures.

When desired it is possible to supply blow air on the backside of a blocking member according to the invention, i.e. into the space defined by the blocking member's surface, which is directed away from the wire. Depending on in which way the blow air is supplied, and depending on the shaping of the components, the pressure difference will press the blocking member in the desired manner towards the wire or away from the wire. On the other hand the gap or slit between the blocking member and the blow nozzle or some other limiting partition can be designed so that the gap or slit will leak air and change the pressure in a controlled way on the backside of the blocking member, when required. This gap can be shaped so that the pressure acting on the blocking member's backside is a function of the distance between the blocking member's surface and the wire. Then the pressure will change in a controlled manner in the space on the backside of the blocking member, for instance when a "paper lump" presses the blocking member inwards into the blow box, and the pressure acting on the blocking member will be reduced. Or, in this way the force towards the wire, caused by the negative pressure, can be reduced at short distances, i.e. when the distance to the wire is short.

A blocking member according to the invention, which "floats" in the air flow, and a blow nozzle connected to it provide a safe structure, which is self-controlled. The jet from the blow nozzle acts as a "bed" between the wire and the blocking member's blocking surface. The distance between the blocking member's blocking surface and the wire can be kept very short in a safe manner.

What is claimed is:

1. A blow box for supporting a web run in a paper machine, said blow box comprising:

a structure;

members arranged on said structure for maintaining a negative pressure in at least one negative pressure region between a wire in the paper machine and said structure of said blow box; and hinge members associated with said members, said hinge members being arranged on said structure, wherein said members comprise blowing members and blocking members, said blowing members ejecting air between said blocking member and said wire, each of said blocking members having a blocking surface facing said wire and a back surface facing away from said wire, said blocking members being arranged at least at one of a beginning and an end of said negative pressure space relative to a running direction of the wire, and each of said blocking members extending across at least a portion of said wire and hingably connected to said structure by corresponding ones of said hinge members such that said blocking member is pivotable about an articulation point of said corresponding one of said hinged members in response to a pressure different between a pressure acting on said blocking surface and a pressure acting on said back surface for maintaining a pressure difference between said negative pressure region and a region outside of said negative pressure region.

2. A blow box according to claim 1, wherein said blocking surface of said each of said blocking members is arched such that said blocking surface forms a Coanda surface.

3. A blow box according to claim 1, wherein at least one of said blocking members is arranged in said structure of said blow box at both the beginning and the end of said negative pressure region, each of said at least one of said blocking members being arranged to remove air by ejection from the negative pressure region.

4. A blow box according to claim 1, further comprising suction members arranged in the blow box between the beginning and the end of the negative pressure region for removing air from the negative pressure region by suction.

5. A blow box according to claim 1, wherein at least one of said blocking members is arranged at the beginning of said negative pressure region, said blow box further comprising a counter weight connected to said at least one of said blocking members to keep said at least one of said blocking members in balance at a desired distance from the wire during at least one of a normal run and during a shutdown, and to maintain said blocking member at a desired distance from the wire.

6. A blow box according to claim 1, wherein at least one of said blocking members is arranged at the beginning of said negative pressure region, said at least one blocking member having a first end connected to said structure by a swing joint at said corresponding one of said hinge members, and said at least one blocking member having a second end extending into said blow box toward one of said blow nozzles arranged at the beginning of said negative pressure region, said at least one of said blocking members being pivotable through a predetermined angle about said articulation point of said corresponding one of said hinge members without being hindered by said one of said blow nozzles.

7. A blow box according to claim 1, wherein at least one of said blocking members is arranged at the end of the negative pressure region, said at least one of said blocking members having a first end connected to said structure by a swing joint at said corresponding one of said hinge members proximate one of said blow nozzles arranged at the end of the negative pressure region, said at least one of said blocking members is pivotable through a predetermined angle about said articulation point of said corresponding one of said hinge members without being hindered by said one of said blow nozzles.

8. A blow box according to claim 1, wherein one of said blocking members is arranged on said structure at the end of the negative pressure region, said one of said blocking members having an output end and input end relative to running direction of the wire, said output end of said one of said blocking members being connected to said structure by a swing joint at said corresponding one of said hinge members, said input end of said one of said blocking members extending toward one of said blow nozzles arranged at said end of said negative pressure region, said at least one of said blocking members being pivotable through a predetermined angle about said articulation point of said corresponding one of said hinge members, without being hindered by the blow nozzle.

9. A blow box according to claim 1, wherein a gap between one of said blocking members and a corresponding one of said blowing members said gap being sufficiently small so it prevents air from escaping from the space between said back surface of one of said blocking members and the blow box into the space between said one of said blocking members and the wire, when the wire is pushed towards said at least one said blocking members and the pressure increases in the space between the blocking surface and the wire, said gap increasing whereby air, which pushes said one of said blocking members towards the wire, escapes from the space between said back surface of said at least one of said blocking and the blow box and creates a decrease of pressure in the space between said back surface and the blow box.

10. A blow box according to claim 1, further comprising a limiter arranged in said structure of said blow box for preventing at least one of said blocking members from being pushed against the wire.

11. A blow box according to claim 1, wherein a length of each of said blocking members in the wire cross direction is approximately equal to a width of the wire.

12. A blow box according to claim 1, wherein at least one of said blocking members is formed by two or more separately rotating blocking member components arranged in a cross direction of the wire, whereby these components are connected in adjacent succession to form an entity extending across the web.

* * * * *

UNITED STATES PATENT AND TRADEMARK OFFICE

CERTIFICATE OF CORRECTION

PATENT NO. : 6,848,195 B2
DATED : February 1, 2005
INVENTOR(S) : Juha Leimu

It is certified that error appears in the above-identified patent and that said Letters Patent is hereby corrected as shown below:

Column 5,
Line 56, replace “19” with -- 18 --.

Signed and Sealed this

Seventh Day of February, 2006

JON W. DUDAS
*Director of the United States Patent and Trademark Office*